United States Patent [19]

Middleton, Jr.

[11] Patent Number: 4,636,802

[45] Date of Patent: Jan. 13, 1987

[54] ELECTRICAL CONNECTOR FOR SPIRAL ANTENNA AND RESISTIVE/CAPACITIVE CONTACT THEREFOR

[75] Inventor: William J. Middleton, Jr., Richardson, Tex.

[73] Assignee: E-Systems, Inc., Dallas, Tex.

[21] Appl. No.: 665,634

[22] Filed: Oct. 29, 1984

[51] Int. Cl.[4] ..... H01Q 1/36

[52] U.S. Cl. ..... 343/895

[58] Field of Search ..... 343/895, 701, 703

[56] References Cited

U.S. PATENT DOCUMENTS

| | | | |
|---|---|---|---|
| 1,679,240 | 7/1928 | Csanyi . | |
| 1,715,952 | 6/1929 | Rostron . | |
| 3,049,711 | 8/1962 | Hooper . | |
| 3,530,504 | 9/1970 | Konishi . | |
| 3,757,344 | 9/1973 | Pereda . | |
| 3,848,164 | 11/1974 | Otte . | |
| 3,852,756 | 12/1974 | Reese . | |
| 4,030,100 | 6/1977 | Perrotti . | |
| 4,101,898 | 7/1978 | Ingram . | |
| 4,101,899 | 7/1978 | Jones, Jr. et al. . | |
| 4,315,266 | 2/1982 | Frosch | 343/895 |
| 4,387,379 | 6/1983 | Hardie | 343/895 |

*Primary Examiner*—Eli Lieberman

[57] ABSTRACT

The problem of recurrent solder joint failure in spiral antennas is solved by the present invention through the use of resistive/capacitive contacts. Specifically, an electrical connector is provided for connecting opposed conductors disposed on a stripline, to a spiral antenna having a pair of dipole conductors disposed on a substrate. The connector includes a housing having a base, and a sidewall for supporting the substrate. A center post having first and second ends, and a cylindrical aperture, is mounted in the housing. The substrate is secured to the first end of the center post, the second end thereof secured to the base of the housing. A stripline contact snubber is supported in an end of the cylindrical aperture adjacent the substrate and receives the stripline. To ensure RF continuity between the stripline conductors and the dipole conductors, one or more mechanically compliant, leaf spring resistive/capacitive contacts are provided. Each of the resistive/capacitive contacts preferably includes a first portion soldered to an opposed conductor of the stripline, and a second portion extending from the first portion. Alternatively, each contact may be an integral extension of one of the stripline conductors. The second portion of each resistive/capacitive contact is compressed between the contact snubber and one of the dipole conductors, and thus placed in abutting relation therewith. Preferably, each resistive/capacitive contact is formed of a flexible metal material, or a metal-plated plastic material.

17 Claims, 9 Drawing Figures

FIG. 2
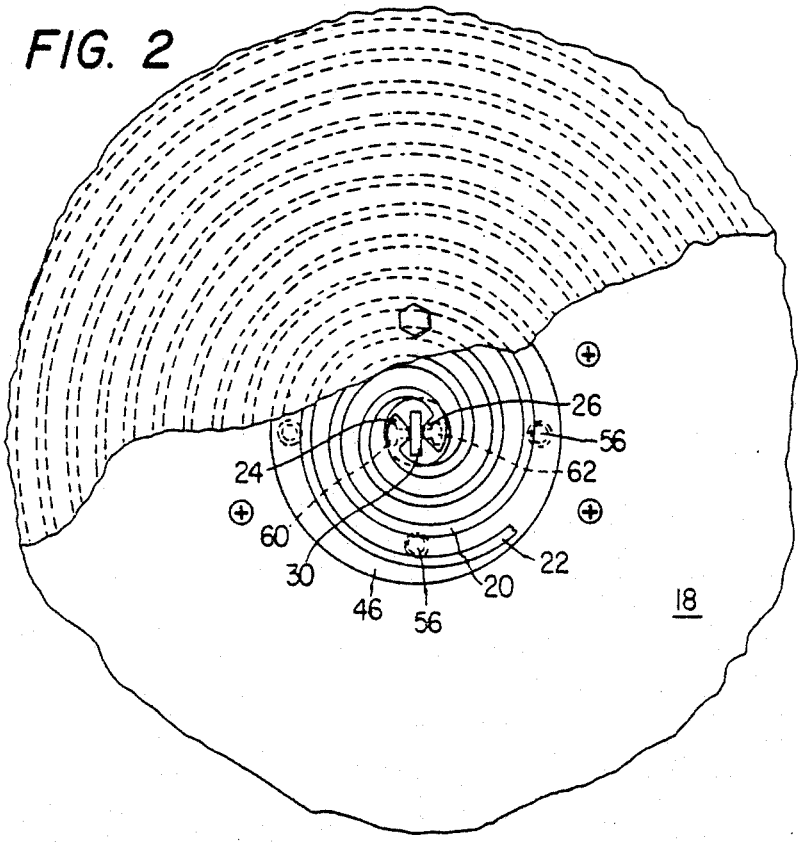
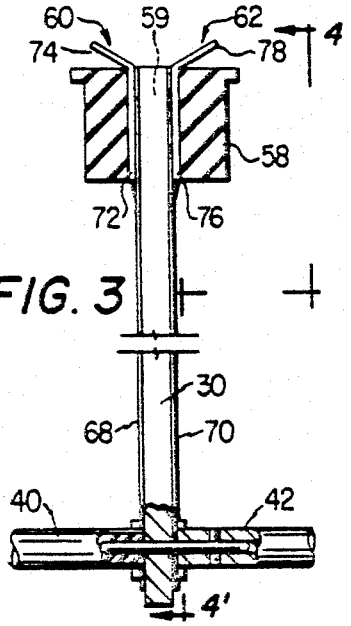
FIG. 3
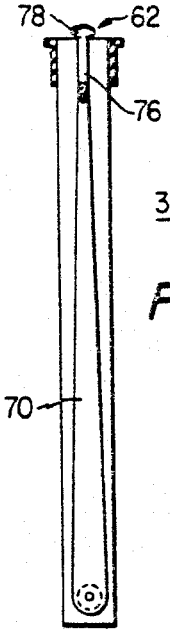
FIG. 4

FIG. 5A
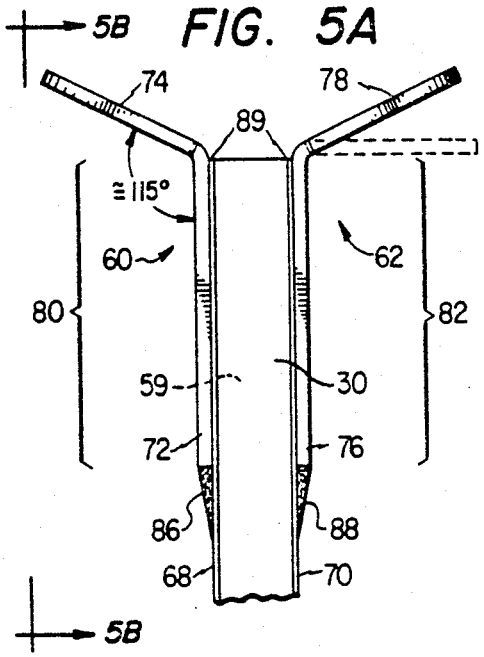
FIG. 5B
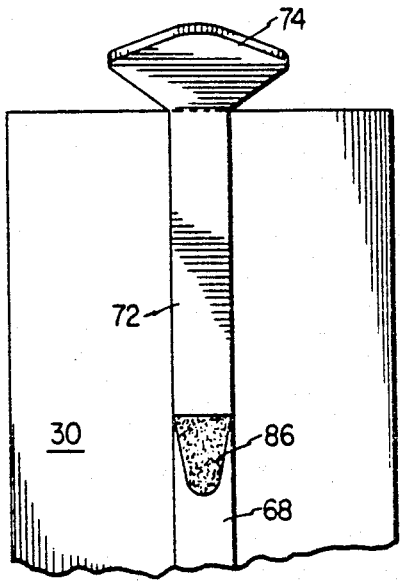
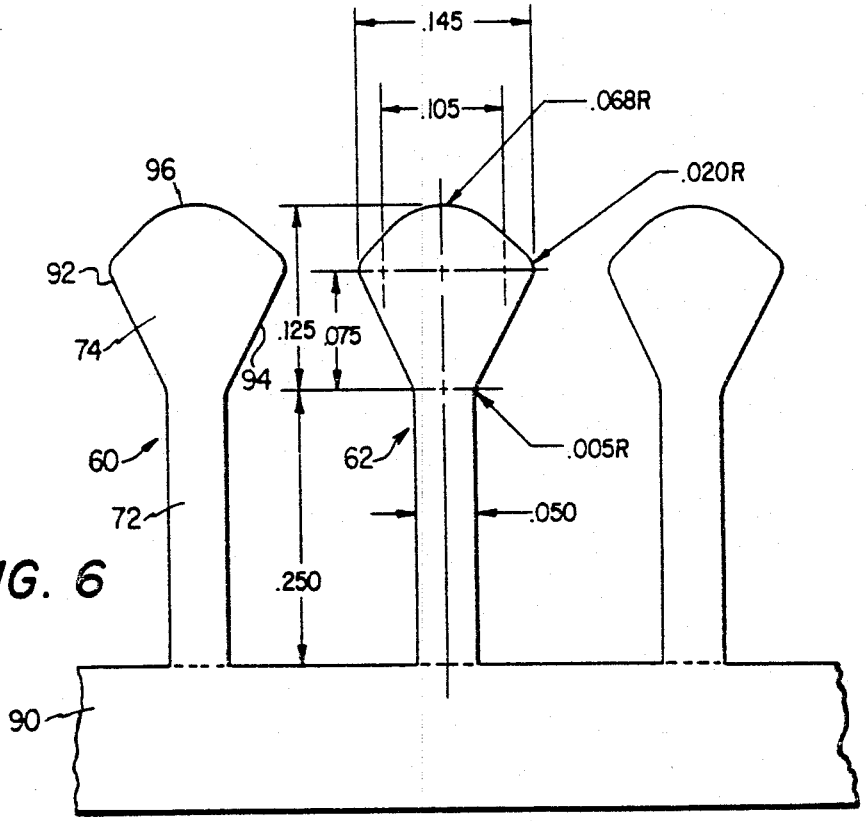
FIG. 6

ELECTRICAL CONNECTOR FOR SPIRAL ANTENNA AND RESISTIVE/CAPACITIVE CONTACT THEREFOR

TECHNICAL FIELD

The present invention relates generally to electrical connectors, and more specifically to a pair of mechanically compliant, leaf spring contacts which form a solderless resistive/capacitive connection between a stripline and a spiral antenna.

BACKGROUND OF THE INVENTION

Spiral antennas, generally characterized by a pair of dipole conductors which spiral inwardly from an outer portion of the antenna to an inner portion thereof, are well known in the prior art. Typically, the inner ends of each of the dipole conductors are disposed adjacent one another and are connected to an RF coaxial connector through a stripline balun assembly. This assembly includes a pair of opposed conductors disposed on a stripline, each of the opposed conductors being normally soldered in an independent manner to an associated one of the dipole conductors of the spiral antenna. In operation, an incident electromagnetic wave excites currents in the dipole conductors, contributing to an inward spiraling balanced electromagnetic wave. The balun serves to convert this balanced wave to an unbalanced coaxial TEM wave, and also transforms the impedance of the dipole conductors to match the characteristic impedance of the RF coaxial connector.

The use of "solder" joints between the stripline and the dipole conductors has proven to be a major cause of operational failure in spiral antenna design. Such joints are subjected to great stress during thermal and/or vibration testing. Also, these joints often fail during field service due to loads imposed by a coincident combination of thermal and vibratory influences, or from either of these singular influences. Such failure is caused by slight mechanical deflection of the dipole conductors. Another source of failure arises from contact/joint corrosion which occurs subsequent to initial assembly of the device. Such corrosion typically takes the form of an oxide build-up on and/or within the solder joint, precluding functional resistive contact.

There is therefore a need to provide an improved electrical connector for connecting a stripline to a spiral antenna which solves the problem of recurrent solder joint failure. Moreover, it is also desirable to obviate such solder joints generally, thus improving thermal compliance and preventing the corrosion normally associated therewith.

SUMMARY OF THE INVENTION

In accordance with the present invention there is provided an improved means for connecting conductors disposed on a stripline, to a spiral antenna having a pair of dipole conductors. To this end, a mechanically compliant, leaf spring contact is utilized in place of the normal solder joint between a conductor of the stripline and a dipole conductor. Preferably, each leaf spring contact includes a first portion, and a second portion normally extending from the first portion at an obtuse angle. During assembly of the spiral antenna, the first portion of each contact is soldered or welded to one of a pair of opposed conductors of the stripline, with the second portion of each contact being placed in abutting relation which an associated dipole conductor of the spiral antenna. In normal operation, each leaf spring contact resistively connects one of the opposed conductors to its associated dipole conductor. However, should this "resistive" contact deteriorate for any reason, e.g., due to thermal, vibratory or corrosive influences, the second portion of each leaf spring contact continues to insure RF continuity by "capacitively" coupling the received RF signal to the stripline.

In the preferred embodiment of the invention, an electrical connector is provided for connecting opposed conductors disposed on a stripline, to a spiral antenna having a pair of dipole conductors disposed on a substrate. This connector includes a housing having a base, and a sidewall for supporting the substrate. A center post having first and second ends, and a cylindrical aperture, is mounted in the housing. The substrate is secured to the first end of the center post, with the second end thereof secured to the base of the housing. The connector also includes a stripline contact snubber supported in an end of the cylindrical aperture of the center post adjacent to the substrate, the snubber serving to receive the stripline in a central aperture thereof. The connector also includes a pair of mechanically compliant, leaf spring contacts, each having a first portion soldered to one of a pair of opposed conductors of the stripline, and a second portion extending from the first portion. In assembling the spiral antenna, the second portion of each leaf spring contact is compressed between the snubber and one of the dipole conductors of the spiral antenna and placed in abutting relation therewith, thereby forming a resistive/capacitive contact for insuring RF continuity between the stripline and the associated dipole conductor of the spiral antenna.

In accordance with a further feature of the present invention, a spiral antenna is provided generally comprising a substrate having a pair of dipole conductors etched thereon, a housing having a base and a sidewall for supporting the substrate, and a center post mounted in the housing. The center post has first and second ends, and a cylindrical aperture, the substrate being secured to the first end of the center post, the second end thereof secured to the base of the housing. The spiral antenna further includes a stripline contact assembly, including: a stripline having opposed conductors etched on sides thereof, a stripline contact snubber supported in an end of the cylindrical aperture adjacent to the substrate for receiving the stripline, and a pair of mechanically compliant, leaf spring resistive/capacitive contacts. Each of the contacts has a first portion, and a second portion extending from the first portion. Upon assembly of the spiral antenna, the second portion of each resistive/capacitive contact is compressed between the stripline contact snubber and one of the dipole conductors, and placed in abutting relation therewith for ensuring RF continuity between the conductor of the stripline and the associated dipole conductor.

Preferably, each of the resistive/capacitive contacts is formed of a flexible metal, e.g., heat-treated beryllium copper, or a metal-plated plastic material. Such contacts are fabricated in a continuous strip by a manufacturing technique known as "chemical milling" or etching.

BRIEF DESCRIPTION OF THE DRAWINGS

For a more complete understanding of the present invention and the advantages thereof, reference is now made to the following Detailed Description taken in conjunction with the accompanying Drawings in which:

FIG. 2 is a sectional top view of the spiral antenna of FIG. 1 detailing the spiral antenna dipole conductors;

FIG. 3 is a sectional view of the stripline contact assembly of FIG. 1B used to connect the RF signals received by the spiral antenna to an RF coaxial cable;

FIG. 4 is a side view of the stripline contact assembly along lines 4—4' of FIG. 3;

FIGS. 5A and 5B are detailed views of the resistive/-capacitive contacts of the stripline contact assembly shown in FIGS. 3 and 4, respectively; and FIG. 6 is a detailed front view showing the preferred flat dimensions of the resistive/capacitive contacts of FIG. 5B during manufacture thereof by chemical milling/etching techniques.

DETAILED DESCRIPTION

Figure 1:
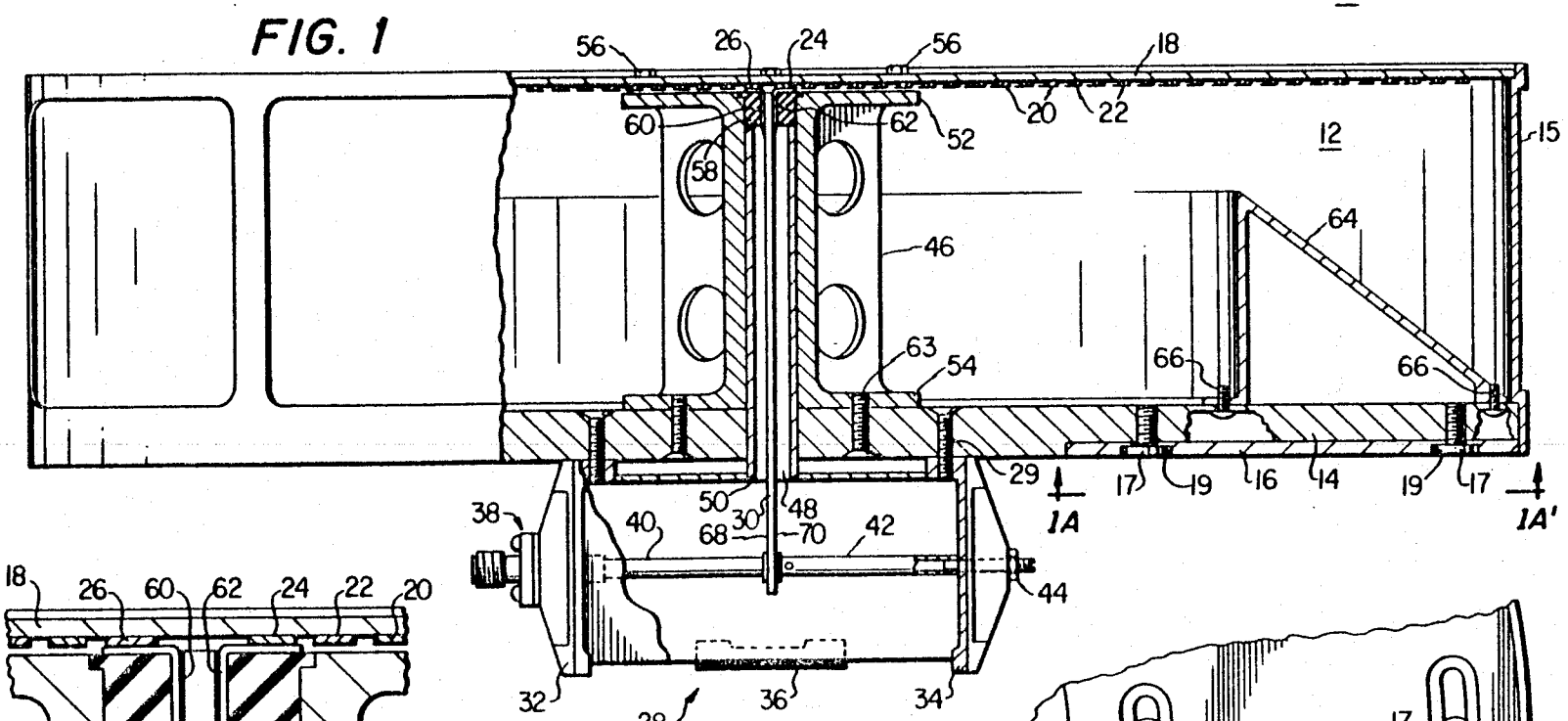
FIG. 1 is a sectional elevational view of a lightweight spiral antenna of the present invention incorporating a pair of resistive/capacitive contacts for connecting opposed conductors disposed on a stripline to a pair of dipole conductors of the antenna.
Figure 1A:
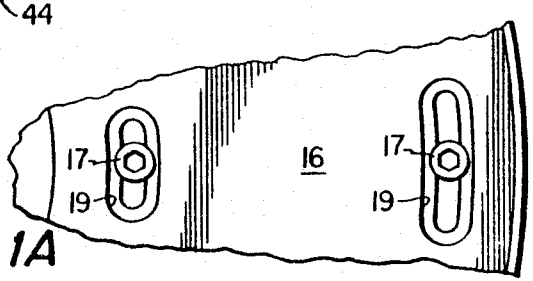
FIG. 1A is a bottom view of the lightweight spiral antenna of FIG. 1 showing the structure of the mounting plate thereof for effecting received signal phase matching.

With reference now to the FIGURES wherein like reference characters designate like or similar parts throughout the several views, FIG. 1 is a sectional elevational view of a lightweight spiral antenna 10. The spiral antenna 10 includes an antenna cavity defined by a housing 12 having a base 14 and an integral circular sidewall 15. A mounting plate 16 is secured to the base 14 of the housing 12 through the mounting screws 17. The mounting plate 16 includes a plurality of circumferentially-spaced arched slots 19 as seen in FIG. 1A for facilitating rotation of the plate 16 with respect to the base 14, thereby effecting received signal phase matching. Specifically, when the spiral antenna 10 is utilized with a plurality of like antennas in an antenna array, rotation of the mounting plate 16 in the slots 19 changes the polarization of the antenna 10 with respect to the other antennas in the array.

Referring back to FIG. 1, the circular sidewall 15 of the housing 12 supports a spiral antenna substrate 18 having a pair of spiral dipole conductors 20 and 22 etched on the underside thereof by conventional photolithographic chemical etching techniques. Spiral dipole conductor 20 includes an end portion 24; likewise, spiral dipole conductor 22 includes an end portion 26.

To facilitate transfer of received RF signals from the spiral conductors 20 and 22, the spiral antenna 10 includes a balun housing 28 secured to the base 14 of the housing 12 by the screws 29. The balun housing 28 supports one end of a stripline 30 which forms part of a stripline contact assembly 31 of FIG. 1B to be described in more detail below. A coaxial connector support endplate 32 is secured to one end of the balun housing 28, the opposite end of the housing having an endplate 34. A cover plate 36 is also provided in the balun housing 28 to facilitate access to the stripline 30. A coaxial connector assembly 38 is connected to the stripline 30 through a portion 40 of coaxial cable. A coaxial contactor 42 is also connected to the stripline 30 and terminates in a compression screw 44. In conjunction with the endplate 34, the compression screw 44 acts as a ground for the center conductor portion of the coaxial cable 40. The RF signal received by the spiral antenna 10 is output to a coaxial line (not shown) via the coaxial connector assembly 38.

An incident electromagnetic wave excites currents in the spiral dipole conductors 20 and 22. These currents contribute to an inward spiraling electromagnetic wave which is similar in configuration to the type of wave found on a balanced two-wire transmission line. The stripline contact assembly 31 serves to connect this electromagnetic wave to the coaxial line attached to the balun housing 28. In particular, the stripline contact assembly 31 is supported by a center post 46 which includes a cylindrical aperture 48 for supporting the stripline contact assembly 31 and a balun tube 50. The balun tube 50 serves to convert the balanced wave on the spiral dipole conductors 20 and 22 to an unbalanced coaxial transverse electromagnetic (TEM) wave. The balun tube 50 also serves to transform the impedance of the spiral dipole conductors to match the characteristic impedance of the coaxial line.

Figure 1B:
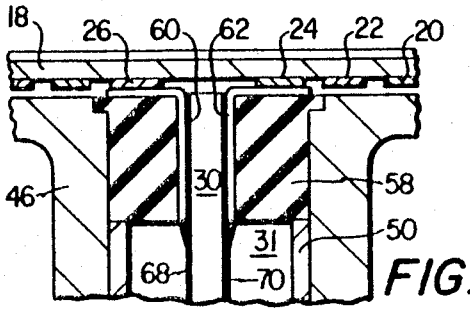
FIG. 1B is an enlarged detailed sectional view of a portion of the spiral antenna of FIG. 1 showing a stripline contact assembly of the present invention.

The center post 46 has a first end 52 and a second end 54. The spiral antenna substrate 18 is secured to the first end 52 of the center post 46 by a plurality of nonconductive screws 56, preferably made of nylon. If desired, the nylon screws 56 can be covered with an adhesive to provide additional locking force. According to a feature of the present invention, the stripline contact assembly 31 includes a stripline contact snubber 58 supported in the first end 52 of the center post 46. With reference to FIGS. 1 and 1B, contact snubber 58 supports the stripline 30 and a pair of resistive/capacitive contacts 60 and 62. As will be described in more detail below, each resistive/capacitive contact includes a first portion soldered to an opposed conductor disposed on the stripline 30, and a second portion abutting the end of one of the spiral dipole conductors 20 and 22. The resistive/capacitive contacts 60 and 62 serve to ensure RF continuity between the stripline 30 and the spiral dipole conductors 20 and 22 as will be described.

As also seen in FIG. 1, the second end 54 of the center post 46 is secured to the base 14 of the housing 12 by the mounting screws 63. The spiral antenna 10 also includes a reflector 64 which is secured to the base 14 of the housing 12 by the fasteners 66. The reflector 64 is provided for changing the specific reflection characteristics of the antenna cavity, thus controlling the gain of the antenna.

Referring now to FIG. 2, a sectional top view of the spiral antenna 10 of FIG. 1 is shown detailing the spiral dipole conductors 20 and 22. In this view the spiral conductors 20 and 22 are shown in phantom since in the final assembly of the spiral antenna 10, a non-etched side of the substrate 18 faces outward. This construction increases the durability of the overall antenna design. As discussed above, the inner ends 24 and 26 of the spiral dipole conductors 20 and 22, resspectively, abut the resistive/capacitive contacts 60 and 62, respectively, to facilitate the transmission of the received incident electromagnetic wave to the RF coaxial cable. FIG. 2 also shows the nylon screws 56 used to secure the spiral antenna substrate 18 to the support post 46.

In prior art spiral antennas, the stripline conductors are typically soldered to the spiral dipole conductors 20 and 22. Such solder joints are a major cause of failure both during testing and field service of the spiral antenna. These joints are subject to large stresses during thermal and/or vibration testing, and often fail during field service due to loads imposed by a coincident combination of thermal and vibratory influences, or from either of these singular influences. Moreover, solder joints are often prone to failure due to oxide corrosion which tends to deteriorate the "resistive" contact produced by the solder.

Accordingly, the present invention incorporates the resistive/capacitive contacts 60 and 62 in lieu of the solder joints normally used to connect the stripline conductors to the spiral dipole conductors. With reference now to FIG. 3, a sectional view is shown of the stripline contact assembly 31 of the present invention. As seen in this view, the stripline contact assembly 31 includes the stripline 30 having first and second opposed conductors 68 and 70 etched on sides thereof. Preferably, these opposed conductors are deposited by standard etching techniques. The resistive/capacitive contact 60 includes first and second portions 72 and 74, the first portion 72 thereof being soldered to the first opposed conductor 68 of the stripline 30. Likewise, the resistive/capacitive contact 62 includes first and second portions 76 and 78, the first portion 76 thereof being soldered to the second opposed conductor 70 of the stripline 30. The stripline contact snubber 58 includes a central aperture 59 through which the stripline 30 and the first portions 72 and 76 of the resistive/capacitive contacts 60 and 62 are supported.

Referring now to FIG. 4, a side view is shown of the stripline contact assembly 31 along lines 4—4' of FIG. 3. As seen in this view, the second opposed conductor 70 of the stripline 30 has a width which progressively decreases along the length thereof with a hole etched therein approximately equal to the diameter of the center conductor of the cable 40. It should be appreciated that the first opposed conductor 70 on the opposite side of the stripline 30 has a similar configuration except the hole etched therein is approximately equal to the diameter of the outer conductor of the cable 40. In the final assembly shown in FIG. 1, the stripline contact assembly 31 of FIG. 4 is surrounded by a balun tube 50 which serves to convert the balanced wave on the spiral dipole conductors 20 and 22 to an unbalanced coaxial transverse electromagnetic (TEM) wave.

Referring now to FIG. 5A, a detailed view is shown of the resistive/capacitive contacts 60 and 62 of FIG. 3. As shown in this view, the first portions 72 and 76 of the resistive/capacitive contacts 60 and 62 are pre-soldered or welded to the first and second opposed conductors 68 and 70 along areas 80 and 82. It should be appreciated that the resistive/capacitive contacts could alternatively be integral extensions of the opposed conductors of the stripline. The first and second portions of each resistive/capacitive contact are integrally formed to define an outwardly facing obtuse angle of approximately 115°. Also, solder fillets 86 and 88 are provided along the bottom edge of each of the contacts 60 and 62 for additional electrical integrity when the contacts are not extensions of the stripline conductors. However, no solder is used at the point 89 where the first and second portions of each resistive/capacitive contact intersect; i.e., at the end of the stripline 30. The point 89 is generally the location of a solder joint(s) in a prior art spiral antenna.

During assembly of the spiral antenna 10, the second portions 74 and 78 of the resistive/capacitive contacts 60 and 62 are deflected by the spiral dipole conductors 20 and 22 and held in abutting relation therewith by the snubber 58. This deflection is represented by the phantom lines in FIG. 5A. Such connection of the stripline 30 to the dipole conductors 20 and 22 is advantageous over prior art solder joints used for the same purpose for several reasons. At the outset, it should be appreciated that during normal operation the resistive/capacitive contacts 60 and 62 "resistively" connect the opposed conductors of the stripline 30 to the spiral conductors 20 and 22 by virtue of being in direct contact therewith. However, should this "resistive" contact be compromised for any reason; e.g., due to vibratory, thermal or corrosive influences, the resistive/capacitive contacts 60 and 62 continue to ensure RF continuity of the spiral antenna by serving to "capacitively" couple the incident electromagnetic wave to the stripline.

Accordingly, the resistive/capacitive contacts of the present invention provide for an improved antenna design, reduce service and inspection time and increase survivability of the spiral antenna during environmental testing and field use. Moreover, the use of such resistive/capacitive contacts according to the present invention reduces the time required for assembly of the spiral antenna, thus reducing the overall cost thereof.

FIG. 5B is a view of the resistive/capacitive contact 60 of FIG. 4. As can be seen in this view, the second portion of each resistive/capacitive contact has a generally fan-shaped configuration. In the preferred embodiment of the invention, each resistive/capacitive contact is formed of a metal such as heat-treated beryllium copper, or of a metal-plated plastic material to form a mechanically compliant, leaf spring contact. As noted above, each resistant/capacitive contact may likewise be an integral extension of the respective stripline conductor. Moreover, preferably each resistive/capacitive contact is also silver plated such that oxide build-up thereon does not comprise the RF continuity of the connection. If desired, the resistive/capacitive contacts can be plated with other conductive materials, such as gold or tin.

Referring now to FIG. 6, a front view is shown of the preferred flat configuration of each resistive/capacitive contact of the present invention during manufacture. As seen in FIG. 6, the resistive/capacitive contacts are formed on a continuous strip 90 of beryllium copper, or a metal-plated plastic material. The second portion of each resistive/capacitive contact includes the sidewalls 92 and 94, which are interconnected by the fan-shaped semi-circular top portion 96. Each resistive/capacitive contact of FIG. 6 is then heat treated and appropriately shaped in a mold to form the design shown in FIGS. 5A and 5B. Although the top portion 96 of each contact is preferably fan-shaped, it should be appreciated that this shape is not meant to be limiting. The top portion 96 need simply have an effective surface area large enough to provide a relatively large "capacitance" at the desired operating frequency range of the antenna, i.e., 0.5 to 2.0 GHz.

In summary, the present invention provides a unique resistive/capacitive contact which, by obviating solder connections between conductors of a stripline and a pair of dipole conductors, ameliorates the problem of recurrent solder joint failure in prior art spiral antennas at the dipole/strips line interface. This problem is solved through the electrical connector of the present invention for connecting opposed conductors of a stripline, to a spiral antenna having a pair of dipole conductors disposed on a substrate. As noted above, the connector includes a housing having a base, and a sidewall for supporting the substrate. A center post having first and second ends, and a cylindrical aperture, is mounted in the housing. the substrate is secured to the first end of the center post, the second end thereof being secured to the base of the housing. A stripline contact snubber is supported in an end of the cylindrical aperture of the center post adjacent the substrate for receiving the stripline. Moreover, a pair of mechanically compliant, leaf spring resistive/capacitive contacts are provided to connect opposed conductors disposed on the stripline to the pair of dipole conductors. Each of the resistive/-capacitive contacts has a first portion soldered to an opposed conductor disposed on the stripline, and a second portion extending from the first portion which, upon final assembly of the spiral antenna, is compressed between the snubber and one of the dipole conductors. This connector serves to ensure RF continuity between the opposed conductors of the stripline and the dipole conductors of the spiral antenna.

Preferably, each resistive/capacitive contact is formed of a heat-treated beryllium copper, and is silver plated. The first and second portions of each resistive/-capacitive contact are integral and define an outwardly facing obtuse angle when the contact is formed. Alternatively, each contact may be an integral extension of an opposed conductor of the stripline.

It should be appreciated that the resistive/capacitive contacts of the present invention advantageously obviate solder joints at the dipole conductor interfaces. Also, thermal compliance at such interfaces over anticipated temperature extremes is assured due to the capacitive coupling provided via the biased compression of the resistive/capacitive contacts. As noted above, these contacts are held against the surface of the dipole conductors by virtue of being sandwiched between the spiral antenna substrate and the stripline contact snubber. The present invention also provides an improved electrical connector for connecting a stripline to a spiral antenna which is unaffected by oxide build-up or other corrosion at the dipole conductor interfaces. Finally, the invention provides a spiral antenna which may be easily assembled since the antenna substrate is simply secured with nylon/dielectric screws. When the screws are torqued to predetermined specification, the RF continuity is at least as reliable as a coaxial connector and can be easily verified by RF testing.

It should further be appreciated that, although the invention has been described in the context of a spiral antenna having a pair of dipole conductors connected to a pair of opposed stripline conductors, the resistive/-capacitive contacts may be utilized for connecting one or more stripline conductors to one or more dipole conductors.

Although the invention has been described in detail, it is to be clearly understood that the same is by way of illustration and example only, and it is not to be taken by way of limitation, the spirit and scope of the invention being limited only to the terms of the appended claims.

I claim:

1. An electrical connector for connecting one or more conductors disposed on a stripline to a spiral antenna having one or more dipole conductors disposed on a substrate, the antenna including a housing having a base and a sidewall for supporting the substrate, comprising:

a center post having first and second ends, and a cylindrical aperture, the substrate secured to the first end of the center post, the second end thereof secured to the base of said housing;

a stripline contact snubber supported in an end of the cylindrical aperture adjacent the substrate for receiving said stripline; and one or more resistive/capacitive contacts, each of said contacts having a first portion and a second portion extending from said first portion, the second portion compressed between said contact snubber and one of said dipole conductors and in abutting relation therewith for ensuring RF continuity between said stripline and said spiral antenna.

2. The electrical connector for connecting a stripline to a spiral antenna as described in claim 1 wherein said first and second portions of each of said resistive/-capacitive contacts are integral and define an outwardly facing obtuse angle when said contact is formed.

3. The electrical connector for connecting a stripline to a spiral antenna as described in claim 2 wherein each of said resistive/capacitive contacts is formed of a flexible metal material.

4. The electrical connector for connecting a stripline to a spiral antenna as described in claim 2 wherein each of said resistive/capacitive contacts is formed of the metal-plated plastic material.

5. The electrical connector for connecting a stripline to a spiral antenna as described in claim 1 wherein said first portion of each resistive/capacitive contact is soldered or welded to a conductor disposed on the stripline.

6. The electrical connector for connecting a stripline to a spiral antenna as described in claim 1 wherein said first portion of each resistive/capacitive contact is an integral extension of a conductor disposed on the stripline.

7. A spiral antenna, comprising:

a substrate having a pair of dipole conductors etched thereon;

a housing having a base, and a sidewall for supporting said substrate;

a center post having first and second ends, and a cylindrical aperture, said substrate secured to said first end of the center post, the second end thereof secured to the base of said housing; and a stripline contact assembly, including:

a stripline having opposed conductors etched on sides thereof;

a stripline contact snubber supported in an end of said cylindrical aperture adjacent said substrate for receiving said stripline; and a pair of mechanically compliant, leaf spring resistive/capacitive contacts, each of said contacts having a first portion, and a second portion extending from said first portion, said second portion compressed between said stripline contact snubber and one of said dipole conductors and in abutting relation therewith for ensuring RF continuity between said stripline and said spiral antenna.

8. The spiral antenna as described in claim 7 further including a balun housing secured to said base of said housing for connecting said stripline to a coaxial cable.

9. The spiral antenna as described in claim 7 further including a rotatable mounting plate secured to the base of said housing for providing received signal phase matching when said antenna is used in an antenna array.

10. The spiral antenna as described in claim 7 wherein said first and second portions of each resistive/capacitive contact are integral and define an outwardly facing obtuse angle when said contact is formed.

11. The spiral antenna as described in claim 10 wherein each of said resistive/capacitive contacts is formed of a flexible metal material.

12. The spiral antenna as described in claim 11 wherein said flexible metal material is heat-treated beryllium copper.

13. The spiral antenna as described in claim 10 wherein each of the resistive/capacitive contacts is formed of a metal-plated plastic material.

14. In an antenna comprising a stripline having one or more conductors disposed thereon, and one or more spiral dipole conductors disposed on a substrate, each of said stripline conductors normally soldered to an associated one of said spiral dipole conductors, the improvement comprising:

one or more mechanically compliant, leaf spring resistive/capacitive contacts, each of said contacts having a first portion and a second portion normally extending from said first portion, said first portion being attached to one of said stripline conductors, the second portion being deflected by one of said dipole conductors and in abutting relation therewith, said contacts serving to ensure RF continuity between said stripline and said antenna.

15. In the antenna as described in claim 14 wherein said first and second portions of each resistive/capacitive contacts are integrally formed.

16. In the antenna as described in claim 15 wherein each of said resistive/capacitive contacts is formed of a flexible metal material.

17. In the antenna as described in claim 15 wherein each of said resistive/capacitive contacts is formed of a metal-plated plastic material.

* * * * *